US008426779B2

(12) United States Patent
Schlipf

(10) Patent No.: US 8,426,779 B2
(45) **Date of Patent: *Apr. 23, 2013**

(54) CARTRIDGE TYPE HEATER

(75) Inventor: Andreas Schlipf, Tuttlinger (DE)

(73) Assignee: Türk & Hillinger GmbH, Tuttlingen (DE)

( * ) Notice: Subject to any disclaimer, the term of this patent is extended or adjusted under 35 U.S.C. 154(b) by 566 days.

This patent is subject to a terminal disclaimer.

(21) Appl. No.: 12/634,045

(22) Filed: Dec. 9, 2009

(65) Prior Publication Data

US 2010/0147826 A1 Jun. 17, 2010

(30) Foreign Application Priority Data

Dec. 11, 2008 (DE) ..... 20 2008 016 439 U

(51) Int. Cl.
*H05B 3/02* (2006.01)

(52) U.S. Cl.
USPC ..... 219/481; 219/546; 219/532; 219/618; 219/628

(58) Field of Classification Search ..... 219/481, 219/532, 618, 628, 629, 630, 236, 243, 525, 219/523, 534–539, 546
See application file for complete search history.

(56) References Cited

U.S. PATENT DOCUMENTS

| | | | | |
|---|---|---|---|---|
| 3,512,114 | A | 5/1970 | Dzaack | |
| 3,977,073 | A * | 8/1976 | Shirey | 29/611 |
| 6,909,843 | B1 * | 6/2005 | Fabrizio | 392/490 |
| 7,592,572 | B2 * | 9/2009 | Schlipf | 219/532 |

FOREIGN PATENT DOCUMENTS

| | | | |
|---|---|---|---|
| DE | 14 40 781 | A | 12/1968 |
| DE | 7031974 | | 1/1973 |
| DE | 84 06 445 | U1 | 5/1984 |
| DE | 88 00 261 | | 2/1988 |
| DE | 94 10 403 | | 8/1994 |
| DE | 197 16 010 | | 10/1998 |
| DE | 101 19 107 | B4 | 1/2002 |
| DE | 202005011686 | | 11/2005 |
| DE | 102006005322 | A1 | 8/2007 |
| EP | 0 756 439 | | 1/1997 |
| FR | 2 734 686 | | 11/1996 |

* cited by examiner

*Primary Examiner* — Toan Le
(74) *Attorney, Agent, or Firm* — McGlew and Tuttle, P.C.

(57) ABSTRACT

A cartridge type heater is provided with at least one hot wire coil (13), which has two coreless coil strands (11, 12), which extend in an insulating material (50) along the two sides of a carrier wall (14). The heater includes an insulating material that is coordinated with the internal diameter of a metal jacket (2). The hot wire ends (9, 10) are provided with terminals projecting from the same end of the metal jacket (2). The hot wire coils (11, 12) are electrically connected to one another in the area of an end edge of the carrier wall (14). This edge is located in the closed end area of the metal jacket (2) and the coils are guided by spacers (45) distributed at the longitudinal edges of the carrier wall (14). At least the terminal-side end of the dimensionally stable carrier wall (14) is provided with an attached coil holder (15, 15/1), to which the hot wire ends (9, 10) are fastened under tensile stress. This keeps the windings of the hot wire coil (13) spaced apart from each other. At least one filling opening (42) is provided for the granulated insulating material (50).

15 Claims, 4 Drawing Sheets

Fig. 19
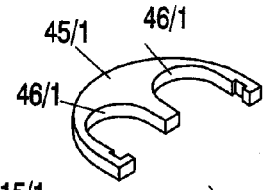
Fig. 15
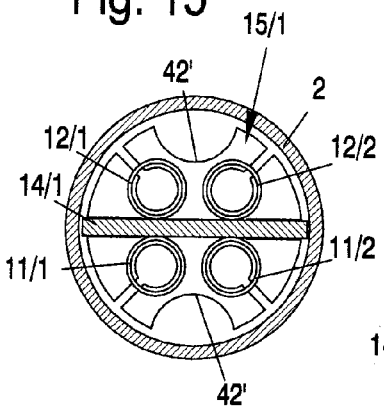
Fig. 15a
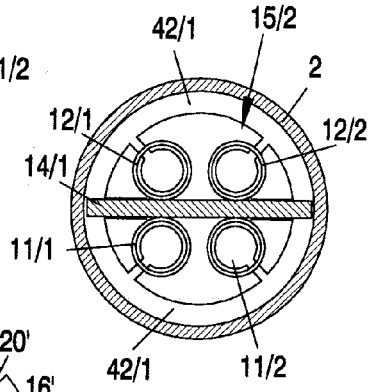
Fig. 18
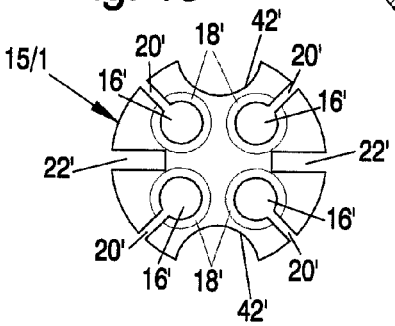
Fig. 21
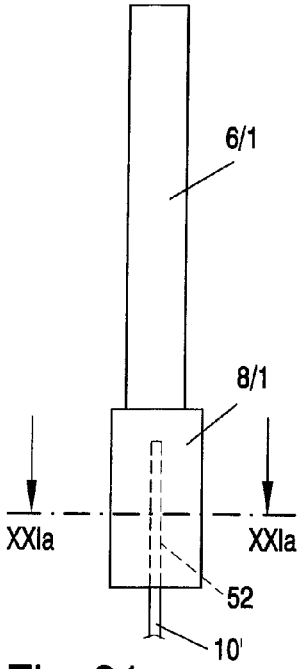
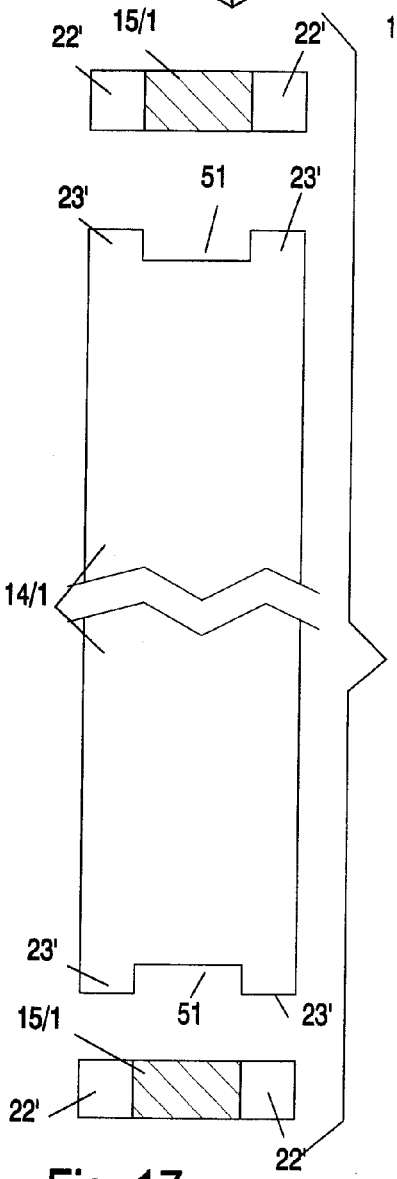
Fig. 16
Fig. 20
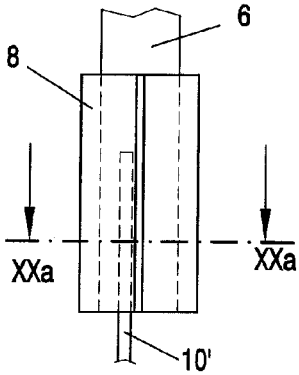
Fig. 20a
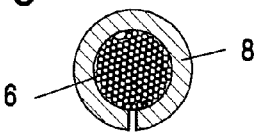
Fig. 21a
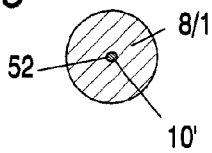
Fig. 17
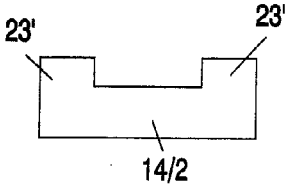

CARTRIDGE TYPE HEATER

CROSS REFERENCE TO RELATED APPLICATIONS

This application claims the benefit of priority under 35 U.S.C. §119 of German Patent Application DE 20 2008 016 439.7 filed Dec. 11, 2008, the entire contents of which are incorporated herein by reference.

FIELD OF THE INVENTION

The present invention pertains to a cartridge type heater (cartridge heater) with at least one hot wire coil, which has at least two, preferably coreless coil strands, which extend along the two sides of a carrier wall consisting of insulating material, whose width is coordinated with the internal diameter of a metal jacket and are embedded in the metal jacket in a granulated insulating material, wherein the ends of the hot wire are provided with respective terminals projecting each from the same end of the metal jacket, and wherein the hot wire coils are electrically connected to one another in the area of an end edge facing the closed end of the metal jacket, which said end is away from the terminal, and wherein spacers made of insulating material, which are distributed over the length of the hot wire coil at the longitudinal edges of the carrier wall and which keep the coil strands insulatingly away from the metal jacket, are arranged, if necessary.

BACKGROUND OF THE INVENTION

As is known from DE 20 2005 011 686 U1, the ends of the two hot wire coils, which are away from the terminals, may be connected to one another by a coil section, which is led around a lower deflecting edge of the insulating material wall. The insulating material wall is used in this prior-art cartridge type heater only to keep the two coil strands mutually spaced apart from one another and thus to electrically insulate them against each other. To keep the coil strands also away from the metal jacket, special, strap-like spacers are provided, which are arranged at more or less great distances and are fastened to the edges of the insulating material wall in a self-holding manner. The filling of the metal jacket with, for example, granular MgO, into which metal jacket the insulating material wall with the two coil strands had already been inserted, is carried out essentially in the vertical position of the metal jacket with the open upper end. The hot wire ends located in the area of this open end of the metal jacket or the terminal connectors connected to these hot wire ends must now be fixed by means of auxiliary means in order to prevent them from interfering with the filling operation, on the one hand, and to prevent them from entering the metal jacket, on the other hand. It is only after filling in the granular material that the metal jacket can be closed by means of a plug, which also has to receive the terminal connector. This working method is very time-consuming and hence cost-intensive.

A compacted cartridge type heater of this class is also known from DE 70 31 974 U. Two or more hot wire coils (heating conductor coils) with different wire thicknesses and different coil diameters are accommodated in this cartridge type heater concentrically with one another lying exposed in a cylindrical cartridge housing, which has a fixed front-side bottom at one end and whose other end is closed by a metal disk with wart-like holes. Instead of the otherwise usual terminal bolts, strands provided with insulating jackets are connected here within the cartridge housing to the ends of the hot wires. These strands are led with their insulating jackets through the metal disk to the inside, so that there is an insulation between the metal disk and the conductor wires of the strands. Means which insulate the coaxial strands of the coil against each other and against the metallic cartridge housing are not provided. The filling in of the granular insulating material is cumbersome and expensive in this cartridge type heater as well.

An electric jacket tube heating body with integrated temperature sensor, in which the hot wire coils are placed in the metallic jacket tube in a hairpin-like manner and the terminal of the heating conductor is led out at one end of the metallic jacket tube and the terminals of the terminal temperature sensor at the other end of the jacket tube, is known from DE 197 16 010 C1. The two strands of the hot wire coil, which extend in parallel to one another, are embedded in compacted insulating material without a partition. It is necessary here to fill the originally granulated insulating material into the two legs of the metallic jacket tube bent in the shape of a U before the ends of the jacket tube are closed with closing plugs.

No support elements, which would ensure that the windings of the heating coil do not come into contact with the tube wall when the insulating granular material is being filled in, are provided for the hot wire coil within the metal tube in these prior-art cartridge type heaters. It is rather to be ascertained during the filling in of the granular material that the hot wire coils are not bent out and are kept away in space from the tube jacket. This makes it difficult to fill in the granular material and causes high manufacturing costs.

SUMMARY OF THE INVENTION

The basic object of the present invention is to provide a cartridge type heater of the type mentioned in the introduction which can be manufactured at a low cost with minimal labor and with the use of a minimal amount of material.

This object is accomplished according to the present invention by at least the terminal-side end of a dimensionally stable carrier wall being provided with an attached coil holder, to which the ends of the hot wire are attached under tensile stress keeping the windings of the hot wire coil spaced apart and which is provided with at least one filling opening for the granulated insulating material or whose contour forms such a filling opening with the metal jacket.

Due to the arrangement according to the present invention and to the fact that a dimensionally stable carrier wall consisting of insulating material is provided with at least one coil holder, which maintains the hot wire coils tensioned along the carrier wall during both the introduction into the metal jacket and during the subsequent filling in of the insulating granular material, the manufacture of such cartridge type heaters becomes substantially simpler and cheaper. Spacers, which keep the hot wire coils away from the metal jacket, may even be dispensed with in case of short metal jackets that do not have a minimal thickness (below 3 mm in diameter). A substantially smaller number of spacers is sufficient than in conventional cartridge type heaters of the type of this class in case of very long cartridge type heaters of 1.5 m in length and longer. In addition, the ends of the hot wire coils may be provided with the terminal elements already before they are introduced into the metal jacket and fixed in their final, functionally correct position to the coil holder or coil holders in a very simple manner, the tensile stress generated also facilitating this operation.

Whether a coil holder is also arranged at the end of the carrier wall that is arranged away from the filling opening of the metal jacket, i.e., at the end of the carrier wall that is located away from the terminal, depends essentially on the thickness of the hot wire, the tensile stress thereof and otherwise also on whether terminal elements for additional switching elements are needed in this area as well. If no coil holder is needed at this end of the carrier wall, which is located away from the terminal, the connecting coil section may consist of a shorter wire section or comprise one or more windings.

For example, a lateral edge of a recess in the carrier wall, which has a certain distance from the bottom of the metal jacket to prevent the coil section led around the deflecting edge from being able to come into contact with the bottom, may be used as a deflecting edge.

Another simple possibility of insulating the coil section led around this lower end edge against the bottom of the metal jacket and of keeping it away from this is to provide a grommet or a spacer ring.

The fillings consisting of granular MgO or quartz sand are usually compacted by radial pressing of the metal jacket.

It is especially simple to fasten the ends of the hot wire to the coil holder due to the embodiment of the present invention wherein the coil holder is provided with passage openings for through passage of the hot wire coil for fastening the hot wire ends to the terminal and the coil holder has support surfaces for the terminals or wherein the passage openings of the coil holder are provided with slots open laterally or only consist of slots.

The embodiment wherein a second coil holder is attached to an end section of the carrier wall and the end section is located away from the terminal and terminal connectors are provided at that end also shows a very advantageous possibility of accommodating safety switching elements against thermal overload in the area of the closed end section of the metal jacket.

It is advantageous for cartridge type heaters that have a greater length to provide spacers. The risk of the hot wire coils coming into contact with the metal jacket can be avoided by these spacers in case of greater overall lengths as well.

The insulation and safety against dielectric breakdown of the hot wire coils against the metal jacket can be considerably increased with the other embodiments wherein a single-layer or multilayer insulating film is placed on the inner surface of the metal jacket and within the insulating film the hot wire coil being embedded in the granulated insulating material. The insulating film may advantageously consist of polyamide.

The embodiments according to claim 10 are provided to also have the possibility of arranging two hot wire coils on each flat side of the carrier wall, in which case the hot wire coils connected each to one another in pairs may be associated with different heating circuits on the two flat sides of the carrier wall.

The present invention will be explained in more detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 15 is a section XV-XV from FIG. 14;

FIG. 15*a* is the same sectional view as in FIG. 15, but with another coil holder;

FIG. 16 is an exploded side view of a carrier wall with corresponding coil holders in a sectional view;

FIG. 17 is a side view of a distance plate from FIG. 14 as an individual part;

FIG. 18 is a top view of a coil holder from FIGS. 14 and 15;

FIG. 19 is a spacer from FIG. 14 as an individual part;

FIG. 20 is an enlarged side view of a terminal connector from FIG. 2;

FIG. 20*a* is a section XVIIIa-XVIIIa from FIG. 18;

FIG. 21 is an enlarged side view of another terminal element for an end of a hot wire; and FIG. 21*a* is a section XX-XX from FIG. 19.

DESCRIPTION OF THE PREFERRED EMBODIMENTS

Figure 1:
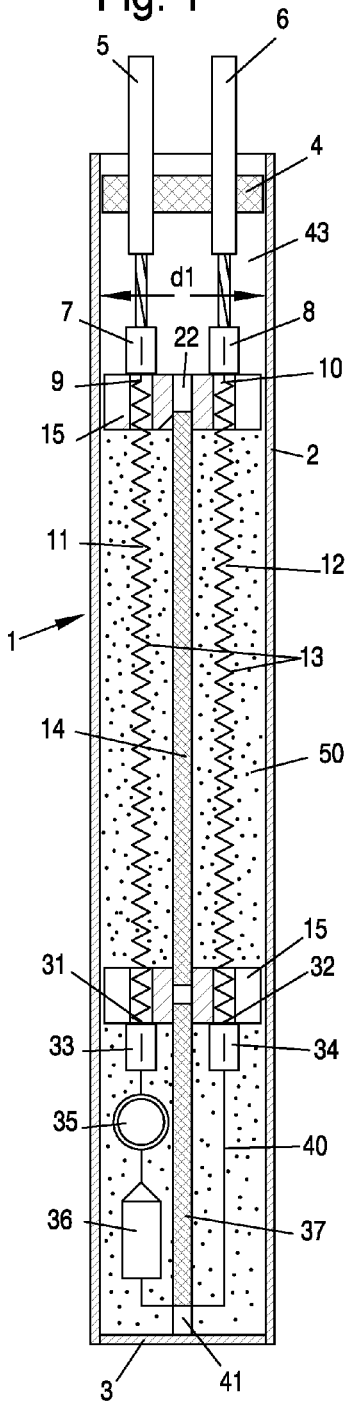
FIG. 1 is a sectional view of a yet uncompacted cartridge type heater with two coil strands and with thermal safety switching elements.
Figure 2:
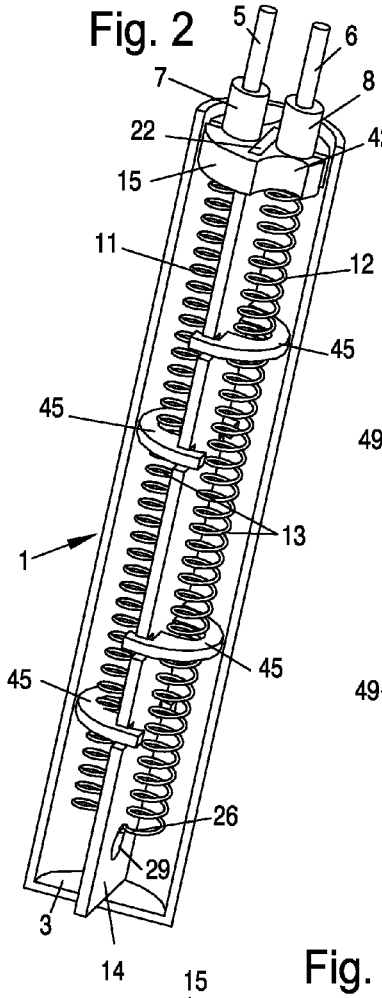
FIG. 2 is a 3D view of the design of the cartridge type heater from FIG. 1 with spacers.
Figure 3:
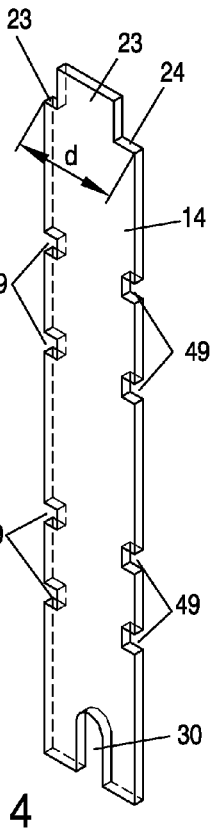
FIG. 3 is an isometric view of the carrier wall from FIG. 2 as an individual part.
Figure 4:
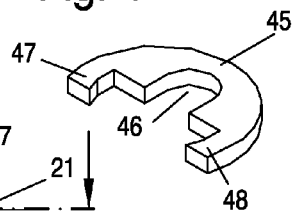
FIG. 4 is a spacer from FIG. 2 as an individual part in a 3D view.

Referring to the drawings in particular, the respective cartridge heaters 1 and 1/1 shown in FIGS. 1 and 2 with wire coil 13 and carrier wall 14 have a cylindrical metal jacket 2 each, which is provided with a fixed bottom 3 and whose upper open end may be closed, as in FIG. 1, by a closing disk 4. Metal jacket 2 preferably consists of copper or stainless steel.

The closing disk 4 consists of an insulating material and is provided with passage holes for two terminal strands 5 and 6. The hot wire ends 9 and 10 of a hot wire coil 13 comprising two coil strands 11 and 12 are connected in an electrically contacting and mechanically tension-proof manner to these terminal strands 5, 6 provided with insulating jackets by means of respective terminal connectors 7 and 8.

The two coil strands 11 and 12 extend along the two flat sides of the carrier wall 14, which is arranged centrally in the metal jacket 2 and which acts as a carrier for the two coil strands 11, 12 of the hot wire coil 13. The width d of carrier wall 14 is coordinated with the internal diameter d1 of metal jacket 2 such that the carrier wall can be pushed easily into the metal jacket, but is guided in metal jacket 2 in such a stable manner that it assumes a central position in it. Carrier wall 14 consists of a dimensionally stable insulating material, e.g., Mikanit, so that it can also be manufactured in great lengths of up to 200 cm or longer and with small widths d of only a few mm. Its necessary dimensional stability, especially its flexural strength, must be high enough to ensure that it can withstand at least the tensile stress of two coil strands ["Wendelstänge" in German original is an obvious typo for "Wendelstränge" meaning "coil strands"-Tr.Ed.], which extend along the two flat sides thereof. To make it possible to arrange at least one hot wire coil 13 with two coil strands 11, 12 each extending along a flat side of the carrier wall 14 in the manner shown in FIGS. 1 and 2 under tensile stress, at least the terminal-side end of carrier wall 14 is provided with a coil holder 15 attached on the front side. The tensile stress is generated by the pulling apart of the hot wire windings when the hot wire coils wound originally with windings located close to one another is pulled out to the greater length of the carrier wall. Prior to this stressing operation, the hot wire ends 9, 10 are connected to the terminal connectors 7 and 8 and by these to the terminal strands 5, 6. It is important in this connection for the terminal connectors 7, 8 to be able to absorb the tensile stress of the coil strands 11, 12. This connection under tensile stress may be established in different ways, e.g., by soldering, welding, clamping, crimping or bending.

Figure 10:
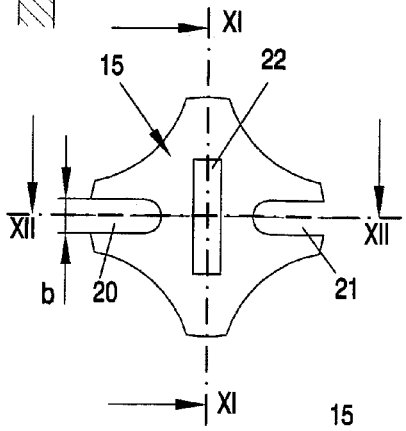
FIG. 10 is a top view of another coil holder.
Figure 11:
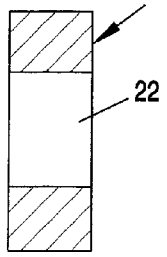
FIG. 11 is a section XI-XI from FIG. 10.
Figure 12:
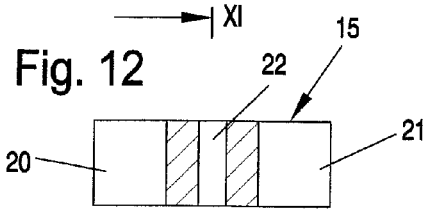
FIG. 12 is a section XII-XII from FIG. 10.

To make it possible to fasten the terminal connectors 7, 8 thus connected to the hot wire ends to the coil holder in a simple manner while generating or maintaining the tensile stress, the coil holder is provided with axial passage openings 16, 17 for the hot wire ends 9, 10 as well as with support surfaces 18, 19. These support surfaces 18, 19 are formed in the coil holders 15 shown in FIGS. 5, 6 as well as 8 and 10 by the lateral surfaces of the passage openings 16, 17 by the terminal connectors 7, 8 having a larger diameter than the passage openings 16, 17. To facilitate the introduction of the hot wire ends into the passage openings 16, 17, passage openings 16, 17 are each provided with laterally open slots 20, 21, or, as is shown in FIG. 10, are designed as such. To form support surfaces for the terminal connectors 7, 8, slots 20, 21 must have a width b (FIG. 10) that is smaller than the diameters of the terminal connectors. As can be determined from FIG. 8, it is also possible, in principle, to design the passage openings 16, 17 as axially extending holes.

Figure 9:
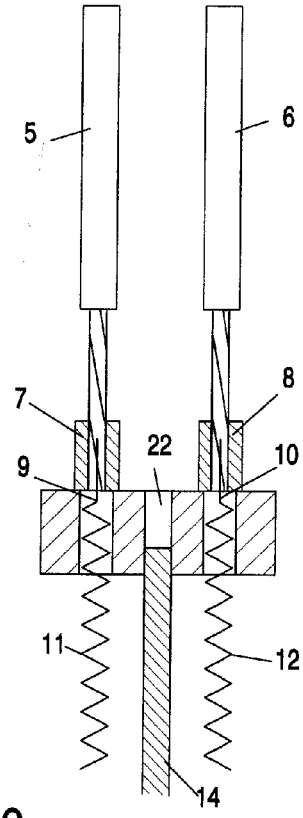
FIG. 9 is an enlarged sectional view of the upper, terminal-side coil holder from FIG. 1.
Figure 9A:
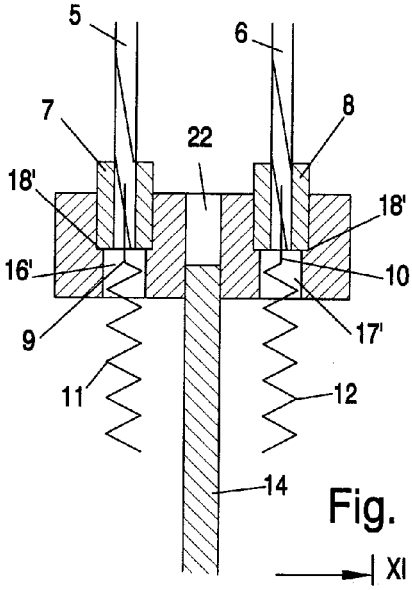
FIG. 9*a* is the same parts as FIG. 9, but with passage openings of a different shape.

It may likewise be advantageous to provide passage openings 16', 17', which have different diameters in a stepped manner, so that, as is shown in FIG. 9*a*, a ring shoulder 18' is formed as a support surface, on which a terminal connector 7, 8 is seated and is also guided at the same time by the hole wall 19' surrounding it in its functionally correct position.

To ensure that the coil holder 15 will have a reliable firm seating at the end of carrier wall 14, coil holder 15 is provided with a preferably continuous mounting slot 22 for an axially projecting centering tongue 23 of carrier wall 14. Since mounting slot 22 and centering tongue 23 are narrower than the carrier wall 14, coil holder 15 is seated on the two lateral shoulders 24, 25 of carrier wall 14.

It may be necessary or at least advantageous in case of cartridge type heaters of a great length to support the two coil strands 11 and 12 against bending. As is known and as is shown in FIG. 2, spacers 45 of a strap-like shape made of insulating material, e.g., ceramic bodies, are provided for this, which are fastened to the carrier wall 14 at appropriate distances from one another, distributed over the length. These spacers 45 have a U-shaped recess 46 each, through which is led a respective coil strand 11 and 12 in order not to come into contact with metal jacket 2.

These spacers are each provided with lateral clamping fingers 47 and 48, which mesh with notches 49 of carrier wall 14 in a positive-locking manner.

The end of the carrier wall 14 located away from the terminal may likewise be provided, depending on the design of the cartridge type heaters, either likewise with a centering tongue 23 or with a deflecting edge 26 only, around which a connection section 27 of the two coil strands 11 and 12 is led. This deflecting edge may be formed, to gain a distance from bottom 3, for example, by the edge of a hole 28 (FIG. 2) or by a limiting edge 29 of a U-shaped or rectangular opening 30.

A coil holder 15, which maintains the terminal connectors 33, 34, which are connected to the ends 31, 32 of the two coil strands 11 and 12 under tensile stress, is also arranged at the lower end of the carrier wall 14, i.e., at the end located away from the terminal, in the mode of construction shown in FIG. 1. The two coil strands 11 and 12 are connected via these two terminal connectors 33 and 34 to thermal safety switches 35, 36, which are connected electrically in series and which may be designed as a fuse, bimetal switch or the like.

To create sufficient space in the metal jacket between the lower coil holder 15 and bottom 3 for the safety switches 35, 36, a spacing wall 37, which is aligned with carrier wall 14, is arranged in this area. This spacing wall 37 is supported on bottom 3, on the one hand, and with two shoulders 38, 39 on the coil holder 15, on the other hand, and a centering tongue 23' protrudes into slot 22 of coil holder 15. The lower end of the spacing wall 37 is provided with a recess 41 to pass through a connection line 40.

The spacing wall may be dispensed with depending on the mode of construction of the safety switches 35, 36.

The assembly unit thus preassembled, comprising the carrier wall 14, the coil holders 15, the coil strands 11, 12 fastened thereto, the terminal connectors 7, 8 as well as 33, 34, the terminal strands 5, 6 and the spacing wall 37 with the safety switches 35, 36, is pushed into the metal jacket 2, which is open on one side, until spacing wall 37 comes to lie on bottom 3.

Figure 5:
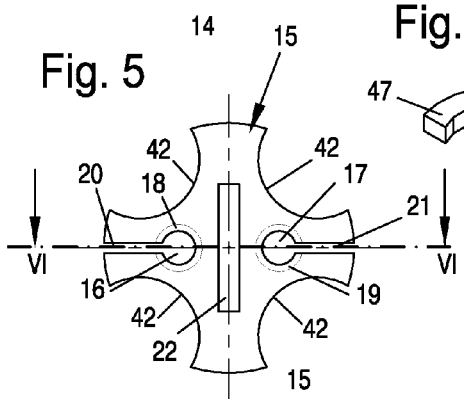
FIG. 5 is a hot wire coil holder from FIG. 1 in an enlarged top view.
Figure 6:
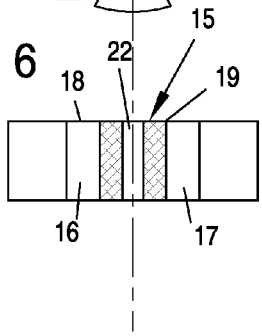
FIG. 6 is a section VI-VI from FIG. 5.
Figure 7:
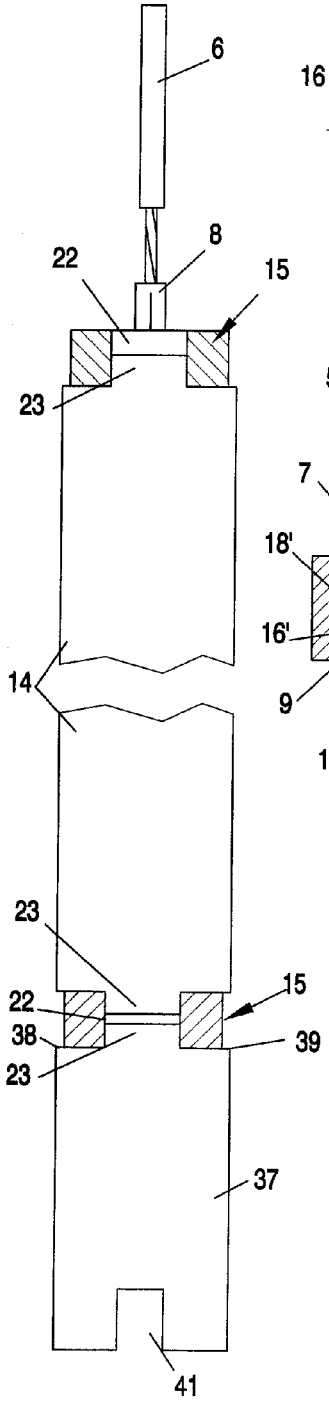
FIG. 7 is a side view of the carrier wall with a distance plate and two coil holders from FIG. 1.
Figure 8:
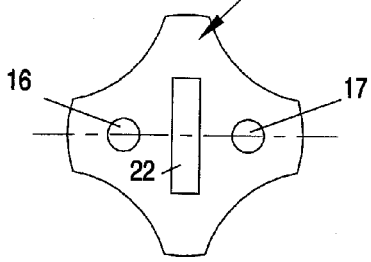
FIG. 8 is a top view of a coil holder from FIG. 7.

To make it then possible to fill the cavities present in the metal jacket 2 under the upper coil holder 15 with granular MgO 20, quartz sand or another free-flowing insulating material in a simple manner, the coil holders 15 are provided on the circumference with a plurality of filling openings 42, which preferably comprise recesses which are open at their edges, as they can be recognized from FIGS. 5, 8 and 10. The cross-sectional shape of these recesses may be selected largely as desired if the stability and tensile load-bearing capacity that is to be obtained for coil holder 15 is taken into account.

Contrary to the embodiment according to FIG. 2, the metal jacket 2 is extended beyond the upper, terminal-side coil holder 15 in the cartridge type heater according to FIG. 1. The cavity 43 formed hereby is likewise filled with the granular insulating material used and closed by means of the closing disk 4.

The compaction by radial pressing of the metal jacket 2 is carried out in this state.

It shall be pointed out here that the drawings show the cartridge type heater 1 in the uncompacted state.

Figure 13:
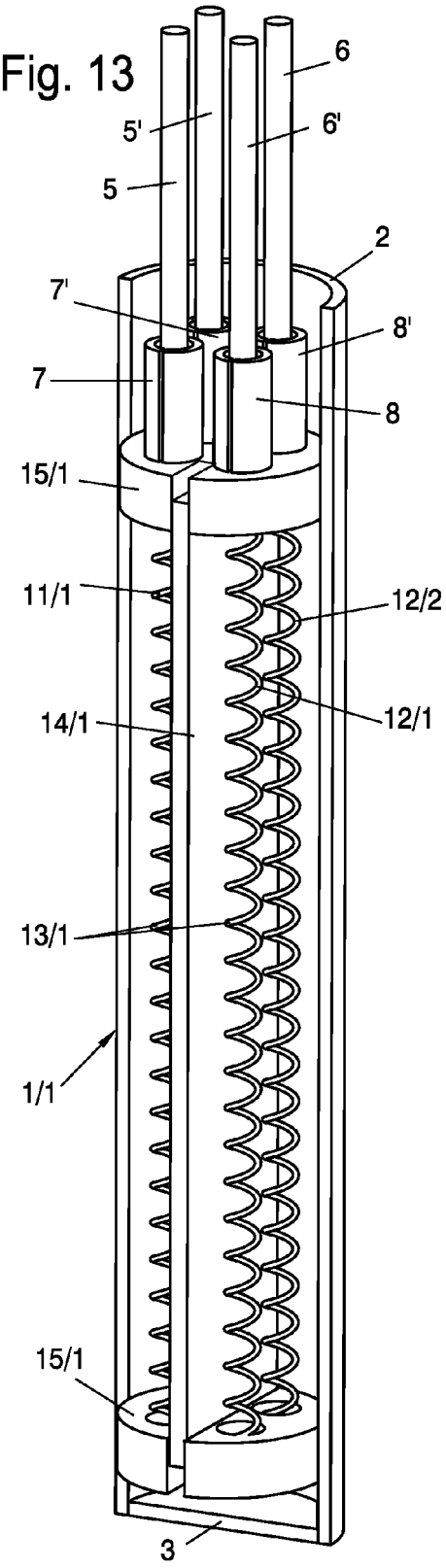
FIG. 13 is the design of a cartridge type heater with four coil strands in a simplified 3D view with a cut-away metal jacket.
Figure 14:
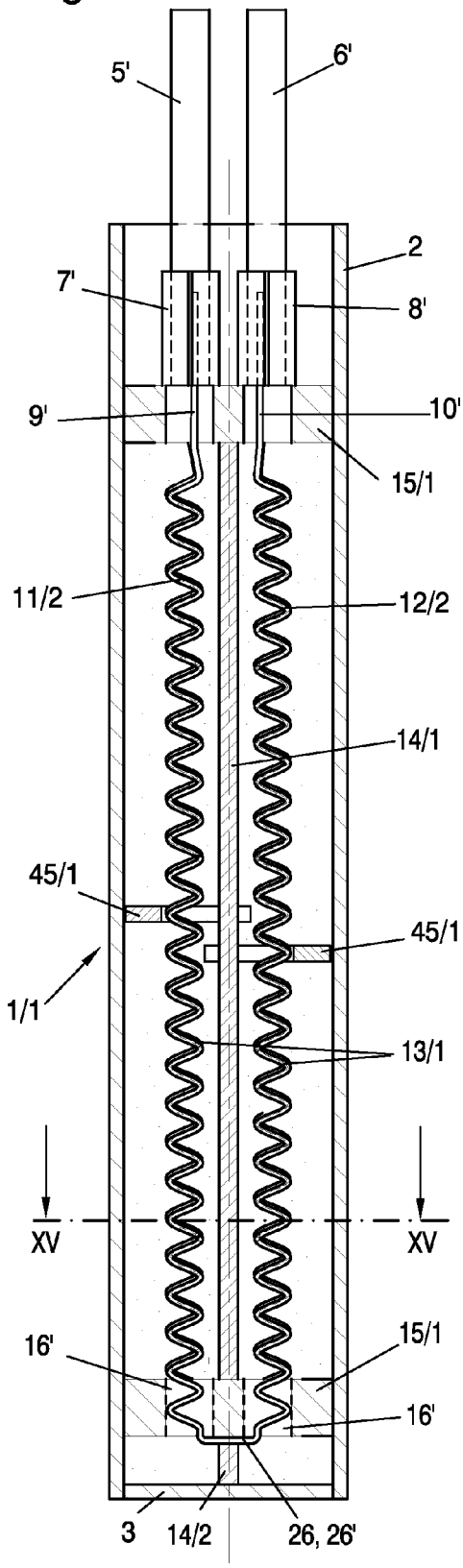
FIG. 14 is a sectional view of the cartridge type heater from FIG. 13.

FIGS. 13 and 14 show different views of a cartridge type heater 1/1, in which two coil strands 11/1, 11/2 and 12/1, 12/2 each, which form a contiguous hot wire coil 13/1 and 13/2, respectively, are arranged on the two flat sides of a carrier wall 14/1.

As is shown in the views in FIGS. 13 and 14, carrier wall 14/1 is provided, at both its upper, terminal-side end and its other end with an attached coil holder 15/1 each, to which the coil strands 11/1 through 12/2 with pulled-apart windings are fastened under tensile stress.

The coil holders 15/1 being used here, which preferably consist of a ceramic body, are provided with four axial holes 16', which are arranged in pairs each symmetrically to the carrier wall 14/1 and whose front-side lateral surfaces form the contact surfaces 18' for the terminal connectors 7, 7', 8 and 8'. The individual coil strands 11/1 through 12/2 are connected to the terminal strands 5, 5' and 6, 6' under tensile stress via the terminal connectors 7, 7', 8, 8'. The lower ends of the coil strands 11/1 and 12/1 as well as 11/2 and 12/2, which said ends are located away from the terminal and which said coil strands form a hot wire coil 13/1 and 13/2, respectively, in pairs, are connected to one another by hot wire sections 26, 26', which are led around the lower front side of the lower coil holder 15 between two holes 16' each.

Contrary to the coil holder 15 in FIG. 5, coil holder 15/1 is provided with two mounting slots 22', which are located diametrically opposite and aligned with one another to be able to receive the two guide tongues 23' of the carrier wall, which said guide tongues are separated from each other by a front-side recess 51, and to offer a stable seating for the coil holder 15/1 when attaching. To make it possible to easily insert the ends 9, 10' of the individual coil strands 11/1 through 12/2, which were fastened in advance to the terminal connectors 7, 7', 8, 8' under tensile stress, into the holes 16', these holes 16' are each provided with laterally open slots 20'.

To establish a reliable or defined distance between the hot wire sections 26, 26' and bottom 3, a distance plate, which is provided with two tongues 23' meshing with the slots 22' of the lower coil holder 15/1, is provided in this embodiment, but said distance plate may also be replaced by other means.

Spacers 45/1 with two openings 46/1, which keep the coil strands 11/1 through 12/1 stressed along the carrier wall 14/1 away from the metal jacket in an insulating manner, may also be provided here in case of correspondingly long embodiments.

This assembly unit can be pushed into the metal jacket 2 intended for this purpose in a likewise simple and time-saving manner in this preassembled state. To enable the granulated insulating material 50, into which the hot wire coils 13/1 and 13/2 will be embedded, to be subsequently filled into the metal jacket 2 easily and as rapidly as possible, the coil holders 15/1 are also provided with laterally open recesses 42'.

FIG. 15*a* shows a coil holder 15/2, which has a smaller external diameter than the coil holder 15/1 while the internal diameter of the metal jacket 2 is equal. An annular gap 42/1, which may also be used to fill in the granular insulating material 50 or instead of the recesses 42' for filling in the granular insulating material 50, is formed as a result between the circumference of the coil holder 15/2 and the metal jacket 2 on both sides of the carrier wall 14/1 in case of concentric arrangement.

As was mentioned already, it is common practice to subject the metal jackets 2 filled with insulating material 50 to radial compaction in order to obtain better results in terms of performance.

Possible examples of a terminal connector are shown in FIGS. 20 through 21*a* as examples only. The terminal connector 8 of FIGS. 20 and 20*a* comprises a preferably slotted sleeve, which surrounds one end of the terminal slot 6, which end is freed from the insulation jacket, together with the hot wire end 10' with a radial stress generated by pressing.

In the embodiment according to FIGS. 21 and 21*a*, the terminal connector 8/1 comprises the thicker end section 8/1 of a cylindrical terminal bolt 6/1, which is provided with a blind hole 52 to receive a hot wire end 10', where said hot wire end 10' can be fastened under tensile stress in said blind hole by pressing or in another manner.

To increase the dielectric strength, it is advantageous to place a single-layer or multilayer insulating film, within which the hot wire coil(s) (13, 13/1) is/are embedded in the granulated insulating material, for example, one consisting of polyamide, on the inner surface of the metal jacket 2.

While specific embodiments of the invention have been described in detail to illustrate the application of the principles of the invention, it will be understood that the invention may be embodied otherwise without departing from such principles.

What is claimed is:

1. A cartridge heater comprising:

a metal jacket;

a dimensionally stable carrier wall consisting of insulating material, the carrier wall having a width coordinated with an internal diameter of said metal jacket;

granulated insulating material in the metal jacket;

a hot wire coil with two coreless coil strands extending along two sides of said carrier wall, said coil strands being embedded in said granulated insulating material, said hot wire coil having hot wire ends;

terminals connected to each of said hot wire ends, said terminals projecting from the same end of said metal jacket, wherein said hot wire coil strands are electrically connected to one another in the area of an end edge of the carrier wall, which said end edge faces a closed end of said metal jacket, said closed end being located away from said terminals;

spacers formed of an insulating material, said spacers maintaining, in an insulating manner, said coil strands in a position away from said metal jacket, said spacers being arranged at longitudinal edges of the carrier wall distributed over a length of the hot wire coil; and an attached coil holder at a terminal-side end of said carrier wall, said coil holder being fastened to said hot wire ends under tensile stress and maintaining the windings of the hot wire coil spaced apart, said coil holder having at least one of a filling opening for the granulated insulating material or a contour cooperating with said metal jacket to form a filling passage for the granulated insulating material.

2. A cartridge heater in accordance with claim 1, wherein the coil holder is provided with passage openings for through passage of the hot wire coil for fastening said hot wire ends to said terminals, said coil holder having support surfaces for said terminals.

3. A cartridge heater in accordance with claim 2, wherein said passage openings of said coil holder are provided with slots open laterally or only consist of slots.

4. A cartridge heater in accordance with claim 1, further comprising:

an overload protection means comprising at least one of a fuse and/or a bimetal switch; and a second coil holder attached to an end section of said carrier wall, said end section being located away from said terminal; and terminal connectors, wherein said two coil strands extend on opposite sides of said carrier wall to ends located away from said terminals that are fastened by means of said terminal connectors to said overload protection means, said terminal connectors being connected to said second coil holder, said second coil holder being attached to said end section of said carrier wall located away from said terminals.

5. A cartridge heater in accordance with claim 1, wherein said spacers comprise ceramic bodies extending around longitudinal edges of said carrier wall, each of said ceramic bodies surrounding a coil strand.

6. A cartridge heater in accordance with claim 1, further comprising a single-layer or multilayer insulating film placed on the inner surface of the metal jacket, within said insulating film the hot wire coil being embedded in the granulated insulating material.

7. A cartridge heater in accordance with claim 6, wherein the insulating film consists of polyamide.

8. A cartridge heater comprising:

a metal jacket;

a dimensionally stable carrier wall formed of insulating material and positioned in said metal jacket, said carrier wall having a width smaller than an internal diameter of said metal jacket, said carrier wall having a terminal end and an opposite end facing a closed end of said metal;

a hot wire coil with two coil strands;

a first terminal connected to an end of a first of said two coil strands and a second terminal connected to an end of a second of said two coil strands, said coil strands being electrically connected to one another at or near said opposite end of said carrier wall;

a coil holder connected to said carrier wall at said terminal-side end of said carrier wall, said coil holder being fastened to said hot wire ends, said coil holder cooperating with said carrier wall to provide said two coil strands extending each along one of two sides of said carrier wall under tensile stress and maintained spaced apart, said coil holder having at least one of a filling opening for the granulated insulating material or a contour cooperating with said metal jacket to form a filling passage for the granulated insulating material;

spacers formed of an insulating material, said spacers maintaining, in an insulating manner, said coil strands in a position away from said metal jacket, said spacers being arranged at longitudinal edges of the carrier wall distributed over a length of the hot wire coil; and granulated insulating material in the metal jacket, said coil strands being embedded in said granulated insulating material.

9. A cartridge heater in accordance with claim 8, wherein the coil holder is provided with passage openings for through passage of the hot wire coil for fastening said hot wire ends to said terminals, said coil holder having support surfaces for said terminals.

10. A cartridge heater in accordance with claim 9, wherein said passage openings of said coil holder are provided with slots open laterally or only consist of slots.

11. A cartridge heater in accordance with claim 8, further comprising:

an overload protection means comprising at least one of a fuse and/or a bimetal switch;

a second coil holder attached to an end section of said carrier wall, said end section being located away from said terminal; and terminal connectors, wherein said two coil strands extend on opposite sides of said carrier wall to ends located away from said terminals that are fastened by means of said terminal connectors to said overload protection means, said terminal connectors being connected to said second coil holder, said second coil holder being attached to said end section of said carrier wall located away from said terminals.

12. A cartridge heater in accordance with claim 8, wherein said spacers comprise ceramic bodies extending around longitudinal edges of said carrier wall, each of said ceramic bodies surrounding a coil strand.

13. A cartridge heater in accordance with claim 8, further comprising a single-layer or multilayer insulating film placed on the inner surface of the metal jacket, within said insulating film the hot wire coil being embedded in the granulated insulating material.

14. A cartridge heater in accordance with claim 13, wherein the insulating film consists of polyamide.

15. A cartridge heater in accordance with claim 8, further comprising:

another holder attached to said carrier wall at or adjacent to said an opposite; and terminal connectors, wherein said two coil strands extend on opposite sides of said carrier wall to opposite ends located spaced away from said terminals, said opposite ends each being connected to one of said terminal connectors, said terminal connectors being connected to said second coil holder, said two coil strands being under tensile stress between said coil holder and said another coil holder.

* * * * *